United States Patent [19]

Bjerkas

[11] Patent Number: 4,539,887

[45] Date of Patent: Sep. 10, 1985

[54] STRING INSTRUMENT OF GUITAR TYPE

[76] Inventor: Johan B. Bjerkås, Skogslyckevägen 14, S-440 92 Svanesund, Sweden

[21] Appl. No.: 574,151

[22] PCT Filed: May 3, 1983

[86] PCT No.: PCT/SE83/00175

§ 371 Date: Jan. 12, 1984

§ 102(e) Date: Jan. 12, 1984

[87] PCT Pub. No.: WO83/04125

PCT Pub. Date: Nov. 24, 1983

[30] Foreign Application Priority Data

May 17, 1982 [SE] Sweden ..... 8203063

[51] Int. Cl.[3] ..... G10D 3/06

[52] U.S. Cl. ..... 84/314 R; 84/267

[58] Field of Search ..... 84/267, 290, 312 R, 84/314 R

[56] References Cited

U.S. PATENT DOCUMENTS 524,114 8/1894 Parker ..... 84/314 R
3,269,247 8/1966 Connors ..... 84/267
3,344,698 10/1967 Ferrara ..... 84/267
4,291,606 9/1981 Lepage ..... 84/291
4,483,233 11/1984 Benson ..... 84/262

FOREIGN PATENT DOCUMENTS 381386 9/1922 Fed. Rep. of Germany .... 84/312 R

*Primary Examiner*—Lawrence R. Franklin
*Attorney, Agent, or Firm*—Harness, Dickey & Pierce

[57] ABSTRACT

A string instrument of guitar type which is constructed to allow both individual notes and chords to be played thereon. The instrument is tuned in such a manner that the pitch difference of the open string notes obtained by adjacent strings (4) alternately is three and four semitones. Each fret (5) on the instrument represents one whole tone. The tuning of the instrument thus is adapted to the traditional occidental harmony of music. The instrument is designed in two different embodiments, viz., as an acoustic instrument and as an electric instrument. As a beginner's instrument in both the acoustic and electric variety it comprises preferably 4 to 6 strings (4). In other embodiments the string instrument is designed to comprise any number of strings between 6 and 13. The increased number of strings increases the range of notes and tone variety of the instrument. The string instrument may be played using available guitar literature as well as existing piano literature.

10 Claims, 8 Drawing Figures

Figure 7:
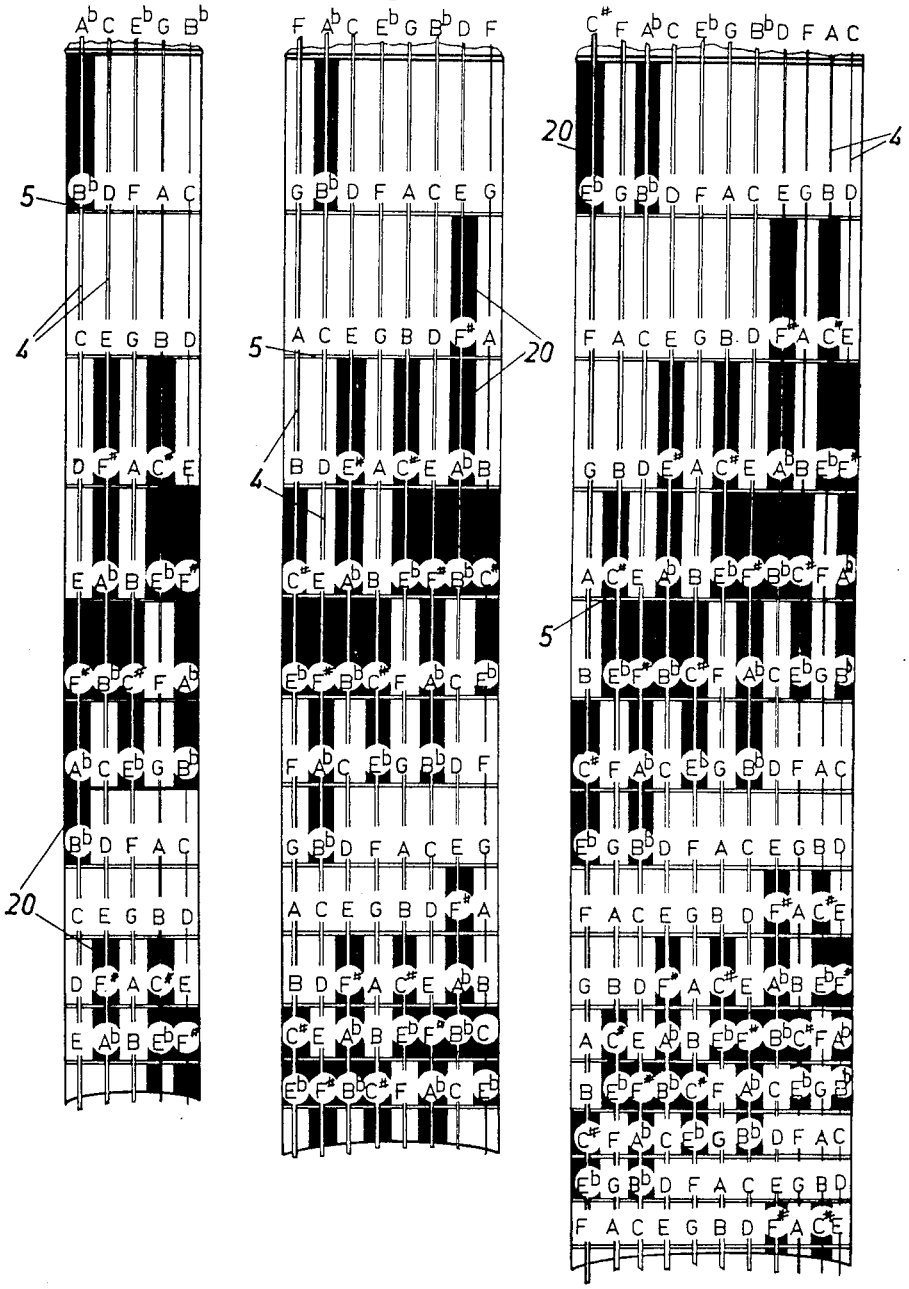

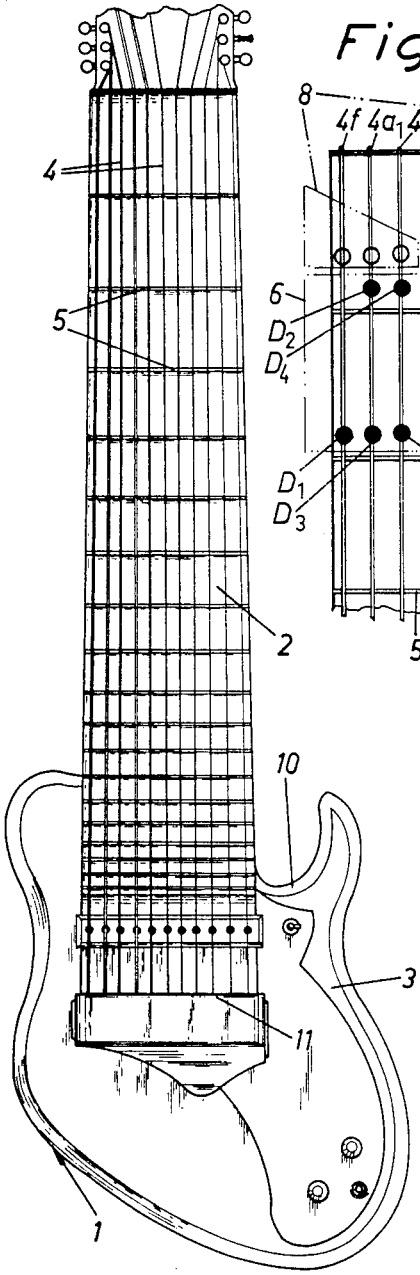
Fig.1
Fig.3
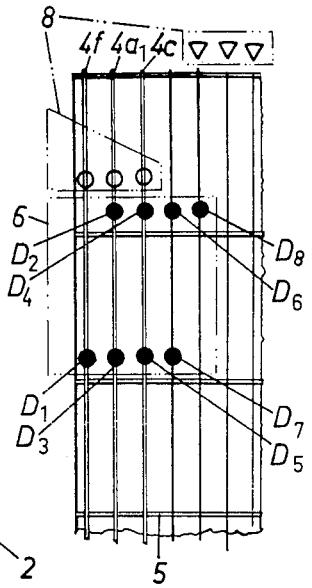
Fig.4
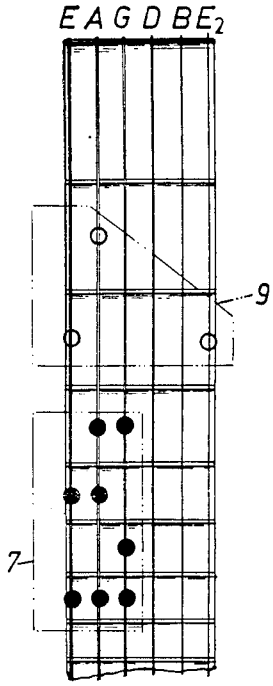

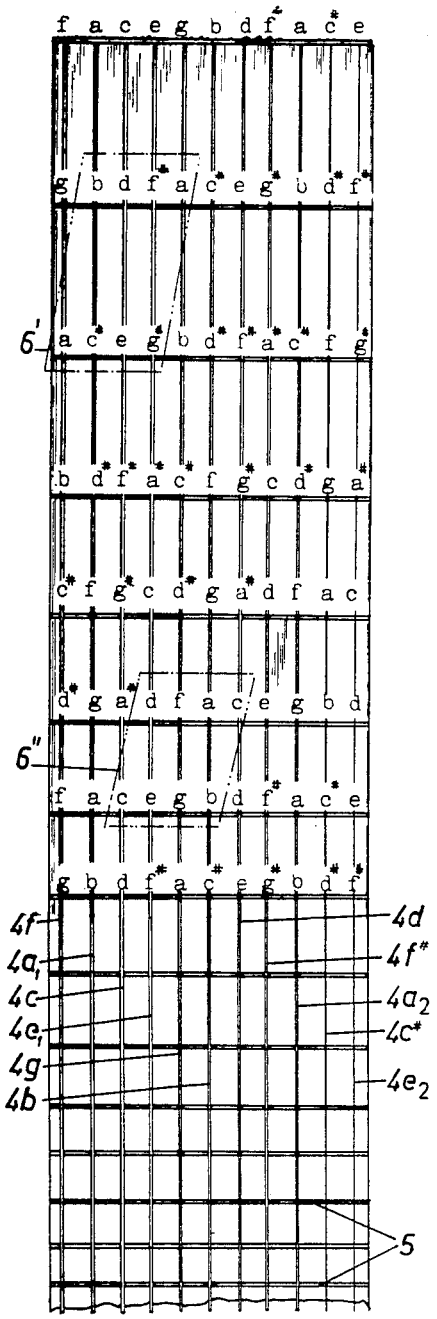
Fig.2
Fig.5
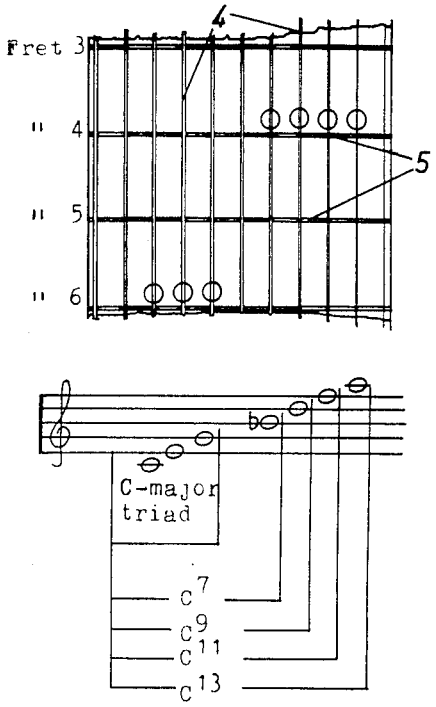
Fig.6
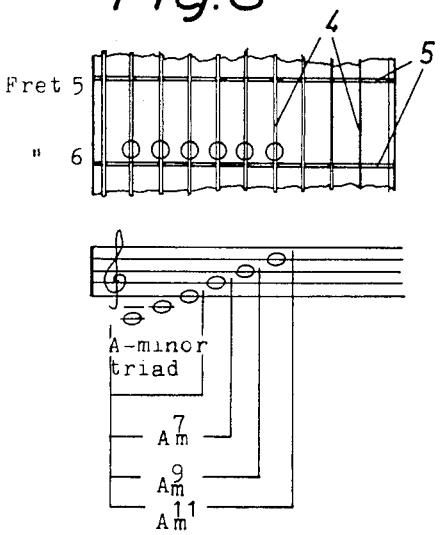

STRING INSTRUMENT OF GUITAR TYPE

The subject invention relates to a string instrument of guitar type. The instrument is intended both for playing individual notes and chords, that is, both for playing melodies and for accompaniment. The instrument may be electric or acoustic and may be provided with the desired number of strings, preferably 4 to 13, depending on the intended field of use and purpose of the individual instrument.

Conventional guitars are tuned in such a manner that there is a pitch difference of five semitones between the tones obtained with the individual strings when open, except between the fourth and the fifth string where the pitch difference is four semitones. In addition, there is a pitch difference of one semitone between each fret. This means that whem major scales are played the player starts from one note, then moves his fingers two frets, that is, two semitones, to play the following note of the scale, then advances a further two frets to the third note of the scale, yet another fret to the fourth note of the scale, and so on. Consequently, the player is required either to have learnt the positions of the notes on the guitar or he must find the note obtained with the open string and establish the positions of other notes on the basis of that note. Obviously, it therefore becomes a rather complex operation to learn to find the positions of the various notes on a conventional guitar. This makes the guitar unsuitable as a beginner's instrument.

The piano, which is the instrument that is most commonly used for basic music teaching, i.e. it is the first instrument to be taught, has a note system which is very easy to learn. Beginners easily learn the positions of the individual notes on the piano keyboard. However, the disadvantages of the piano are that it is an expensive instrument and a bulky one.

The majority of the printed music and music books is written for the piano. Composers also largely write for the piano. The development of modern music (rock and popular music) has, however, popularized the guitar, it being the predominant instrument in the execution of these types of music. In this respect it is a considerable disadvantage that only a comparatively small proportion of the music that exists in printed form is written for an instrument as popular as the guitar.

The purpose of the subject invention is to design and construct a string instrument which allows the player to find the desired notes on the guitar very easily and with the aid of which it becomes considerably much easier to play melodies as well as chords, for instance when playing classical music where melodies are mingled with accompaniment in the form of chords.

A special purpose is to provide an instrument in accordance with the invention, which is coordinated with the existing piano literature and conventional music books without the music therein having to be rewritten or specially adapted to the string instrument.

A further purpose of the invention is to make it easier to write music for the piano and for the string instrument in accordance with the invention. This becomes possible because the subject instrument and the piano are adapted to one another in a way that the conventional guitar and the piano are not.

In addition, the string instrument in accordance with the invention is more closely adapted to the traditional occidental harmony of music than is the traditional guitar.

In accordance with the invention these purposes are obtained in an instrument which easily lends itself to be played at the beginner's level as well as professional levels.

The above and other purposes are achieved in a string instrument in accordance with the subject invention, the instrument being characterised in that each fret on the fingerboard represents a whole tone and in that adjacent strings are tuned in such a manner that the open string notes of these strings are distinguished from one another by alternately four and three semitones, that is, they are tuned alternately to major and minor thirds.

Further characteristics will appear from the dependent claims.

The string instrument arranged in accordance with the invention provides a large number of advantages. Above all, playing becomes easier, particularly for beginners, both as regards the playing of melodies and of chords. Particularly mixed music playing (classical music) involving a mixture of melody and chord playing, is facilitated. This type of music is considered difficult to play on conventional guitars. The subject string instrument is more like the piano as regards the underlying principle of the positions of the notes, which makes the instrument according to the subject invention highly suitable as a beginner's instrument.

Another important advantage is that playing complex chords is highly facilitated compared with what is possible with conventional guitars. Many chords which simply cannot, or only with the greatest difficulty be played on a conventional guitar, are easy to execute on the instrument in accordance with the invention.

In addition, richer-sounding chords, comprising more notes, are more easily obtained.

A particular advantage found in the string instrument in accordance with the invention is that it may be arranged in various ways, a simple variety comprising 4 to 6 strings intended for beginners. This variety may be arranged for later supplementation by application of a further number of strings.

The possibility of varying the instrument to suit musicians possessing various degrees of skill by using for instance 4, 6, 8 or 11 strings or more, is another important advantage of the invention. This creates possibilities for varied and advanced music playing.

The instrument may be designed as an electric bass incorporating for instance 7 strings or as a more conventional electric instrument with the desired number of strings.

Special effects are easily obtained on the instrument, such as a scale of whole tone notes, by running the finger along the fingerboard.

Perhaps the most important aspect of the new instrument is the pedagogical design of its fingerboard which makes it easy for the pupil/beginner to understand the principles of the harmony of music.

Preferably, the fingerboard is designed in such a manner that it corresponds to the white and black keys on a piano keyboard. The player of the instrument therefore easily obtains a visual picture of the fingerboard in the same manner as a piano player does, which is an essential pedagogical advance in a string instrument.

Additional important advantages of the string instrument in accordance with the subject invention will appear from the following description.

Available printed music for the guitar as well as existing sheet music for the piano may be used to play the string instrument in accordance with the invention. This possibility is an important advantage since most music is written for the piano. The piano literature, e.g. the works of the great masters in music, thus becomes directly available to the player of the subject instrument without complicated adaptations.

Playing the instrument in accordance with the invention in principle differs from that on conventional guitars in that on the instrument in accordance with the subject invention playing is performed to a large extent across the width of the neck whereas on a conventional guitar the playing is performed more lengthwise, that is in the longitudinal direction of the strings.

Figure 8:
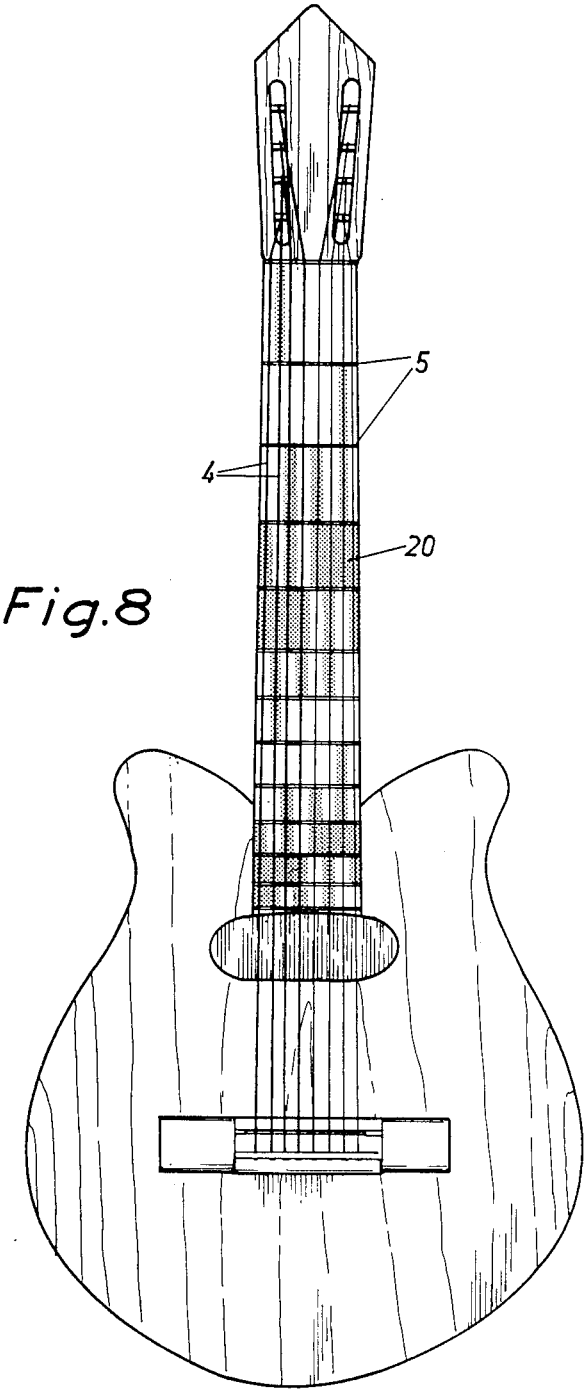

Some embodiments of the instrument of the subject invention will be described in closer detail in the following purely by way of example and the applications and usages of the instrument will be exemplified in the following with reference to the accompanying drawings, wherein FIG. 1 is a plan view of a string instrument in accordance with the invention, FIG. 2 is a fingerboard with strings of the string instrument of FIG. 1, FIGS. 3 and 4 show diagrams of major scales on respectively the instrument in accordance with the invention and a conventional guitar, FIG. 3 corresponding to the upper left part of the fingerboard of FIG. 2, FIGS. 5 and 6 are diagrams showing two different chords on the instrument of the invention, FIG. 7 shows the fingerboards of three different embodiments of string instruments in accordance with the invention comprising 5, 8 and 11 strings, respectively, black and white fields indicating the notes corresponding to the black and white keys on a piano keyboard, and FIG. 8 is a front view of a string instrument in accordance with the invention.

For the sake of consistency, the notes which on the piano keyboard are played on the black keys are identified in the following description as notes sharpened by one semitone from the adjacent lower note rather than flattened by one semitone from the adjacent higher note. In FIG. 7, on the other hand, the notes are indicated in a conventional manner.

FIG. 1 illustrates a string instrument 1 in accordance with the invention comprising 11 strings and designed for electric playing. In the conventional manner it has a neck 2 and a body 3. A corresponding acoustic variety is also possible (see FIG. 8).

FIG. 2 shows one example of the positions of the notes on the fingerboard of an instrument in accordance with the invention comprising 11 strings 4. In the conventional manner the lowest string is positioned at the far left of the diagram (tuning diagrams for left-handed players will be a mirror-image of that shown) and is tuned in the manner indicated in this example to the note f with the open string, called 4*f*. Each fret 5 represents one whole tone, which means that the subsequent notes on the f-string 4*f* are g, a, b, c#, d# and again f, which completes an octave, and the same cycle is repeated. The strings are distinguished by their open string note, for instance 4*f*, 4*c* and, in case the open-string notes of two strings differ by one octave, these strings are given also a digit indicating order, such as for instance $4a_1$, $4a_2$. The second string on the instrument is tuned to open string note a (the string is called $4a_1$), which is four semitones (or two whole tones) higher than note f. The notes obtained on this string thus are notes a, b, c#, d#, f, g, a, and so on, that is, the same notes as string 4*f* but displaced by two frets. The third string is tuned to open string note c, that is, three semitones higher than $4a_1$ and it is called 4*c*. The notes obtained on this string are c, d, e, f#, g#, a# and again c, which completes the octave. It is important to note that despite the fact that each fret on the instrument represents one whole tone or whole step, all semitones nevertheless are obtainable on the instrument in that the strings, for instance strings 4*f* and 4*c*, are complementary in the sense that together they comprise all semitones. The fourth string $4e_1$ is tuned to open-string note e, that is four semitones (or two whole tones) higher than 4*c*. The notes on the string $4e_1$ are the same as those on 4*c* but displaced by two frets. The remaining strings on the instrument are tuned in accordance with the same principle, that is their open string notes are distinguished from one another by alternatingly four and three semitones. In accordance with the embodiment shown there are eleven strings on the instrument, and the strings after string $4e_1$ therefore are 4*g*, 4*b*, 4*d*, 4*f*#, $4a_2$, 4*c*#, and $4e_2$.

Thanks to the principle of positioning the notes on the instrument the scales are easy to find. FIG. 3 shows the principle of playing a major scale on the instrument of FIG. 1 of the invention. The major scale is found within rectangle 6. The fundamental note (in the example shown note a) of the scale is note $D_1$. The following note $D_2$ on the scale is positioned one fret above $D_1$ on the next string designated $4a_1$, the open-string note of this string is distinguished by four semitones from the open-string note of string 4*f* comprising note $D_1$. The third note $D_3$ of the scale is positioned on the fret below $D_2$ on the same string. The fourth note $D_4$ is positioned on the next string 4*c* and so on according to the system illustrated in FIG. 3. The scale of A major is also illustrated within the parallelogram 6' of FIG. 2. Four further exemplification of a scale on the instrument in accordance with the invention the notes of the scale of C major are illustrated in FIG. 2 by the parallelogram 6''. In FIG. 4, which refers to a conventional guitar, the positions of the notes of a scale of A major are shown within the rectangle 7. The scale, however, has a different appearance when the B-string or the $E_2$-string (FIG. 4) are involved since these strings do not have the same open string note difference as the others. As a comparison between FIGS. 3 and 4 makes apparent major scales are more simple to play on an instrument in accordance with the invention. This is also true of minor scales.

The notes of a major scale extend over four frets on a conventional guitar, which means that is is difficult—particularly for beginners—to strike the correct note. On the instrument in accordance with the invention the notes extend only over two frets, also when the instrument comprises only five strings.

FIGS. 3 and 4 also show the appearance of a basic chord, in the case illustrated G major. On the instrument in accordance with the invention this chord is positioned in the manner illustrated in boxes 8 in FIG. 3, that is, the two groups, each comprising three notes viz. g, b, and d, are on the same fret on neighbouring strings. FIG. 4 shows the corresponding more complicated chord position on a conventional guitar. In this case, the chord is formed by the notes within box 9 and by the D, G and B notes on the intermediary, open strings. In the same way, other basic chords in major are correspondingly more easy to play on the subject instrument than on a conventional guitar.

FIGS. 5 and 6 show further examples of chord note positions on the instrument in accordance with the invention, these chords being considerably simplified in comparison with corresponding chords on a conventional guitar. FIG. 5 illustrates the C major triad as the basic chord supplemented by further notes to form chords $C^7$, $C^9$, $C^{11}$, and $C^{13}$. As appears from the figure these chords comprising supplementary notes become very simple to play.

FIG. 6 shows the chord of A minor (triad) with supplementary notes to form the chords A minor$^7$, A minor$^9$ and A minor$^{11}$, all of which are positioned on the same fret, as illustrated.

As mentioned initially and shown by examples in the description, scales and basic chords are easily found on the instrument. Also more complex chords are easily found thereon. The distance between the frets is comparatively large. This means that the instrument in accordance with the invention may be played on further down the neck, that is, closer to the bridge than is possible on conventional guitars. The frets will be spaced apart by such large distances that it becomes possible to press down the string between the frets and obtain a note. This makes it possible, when the instrument in accordance with the invention is electric, to include such a larger number of frets that each string obtains a playable tone range of up to three octaves. Conventional guitars normally comprise twenty-two frets, although variations may exist, that is a tone range for each string of twenty-two semitones or appr. only two octaves. Consequently, the instrument in accordance with the invention has a larger tone range than conventional guitars. FIG. 1 shows the formation in the body 3 of the instrument of a recessed portion 10, which allows the player to reach the frets closest to the bridge 11 of the instrument. Despite the increased range of notes the neck may be short since a smaller number of frets is used than in conventional guitars.

FIG. 7 shows three different embodiments of the string instrument in accordance with the invention. The fingerboard of the string instrument is shown as provided with five, eight and eleven strings, respectively. FIG. 7 indicate suitable tuning diagrams for the various embodiments and a suitable number of frets for each embodiment, viz. ten frets for the five-stringed variety, twelve frets for the eight-stringed variety and fourteen frets for the eleven-stringed variety of the instrument.

In FIG. 7 the notes which correspond to the black keys on a piano keyboard are indicated in black. This marking may be in the form of black glued-on labels 20 and could also comprise white labels to indicate the rest of the notes. With the aid of markings of this kind a pupil/beginner can, in an easy and pedagogic manner, learn the elements of harmony through the visual picture he gains of the fingerboard in exactly the same way as the piano player does of a piano keyboard. The fingerboard picture may be coordinated with the claviature of the piano. When the tuning is different the labels are re-organized.

The five-string instrument is primarily intended as a beginner's instrument because its fingerboard is narrow, which makes it possible also for very young children to play the instrument in accordance with the invention. A conventional guitar comprises six strings and therefore its fingerboard is wider and larger hands are required to play it. In this manner the instrument becomes available to younger children. In addition, the choice of five strings means that a scale will be positioned on two frets across the neck of the instrument.

The tuning illustrated for the five-stringed instrument is ideal as it means that the tuning of the string instrument is very closely related to the tuning of the piano. It should be noted that the "white" notes are assembled on the same frets. FIG. 7 also shows the correspondence between the three various embodiments of the string instrument. It is possible to regard the five-stringed instrument as a basic instrument which may be supplemented by a further number of strings to provide a string instrument comprising eight or eleven strings as desired.

FIG. 8 shows an acoustic variety of an eight-stringed instrument in accordance with the teachings of the subject invention. The black and white areas on the fingerboard indicate the notes, which correspond to the keys of the piano keyboard.

The embodiments of the invention described in the aforegoing are to be regarded as examples only and a number of modifications and varieties are possible within the scope of the appended claims. Details, such as the number of frets and the number of strings, may, as suggested, be chosen according to wish. Also other notes than those shown may be used as the notes obtained on the open strings of the instrument, provided the pitch difference between the open-string notes is the one defined in the main claim.

The string instrument may also be provided with special bass strings.

I claim:

1. A string instrument of guitar type, characterised in that each fret on the fingerboard represents a whole tone and in that adjacent strings are tuned in such a manner that the open string notes of these strings are distinguished from one another by alternately four and three semitones, that is, they are tuned alternately to major and minor thirds.

2. A string instrument in accordance with claim 1 intended to be used as a beginner's instrument, characterised in that it comprises between 4 and 6 strings.

3. A string instrument in accordance with claim 2, characterised in that the instrument is arranged to allow the application thereon of a further number of strings.

4. A string instrument in accordance with claim 3, characterised in that the fingerboard of the instrument is provided with marks indicating the notes which correspond to the black and white keys of a piano keyboard.

5. A string instrument in accordance with claim 2, characterised in that the fingerboard of the instrument is provided with marks indicating the notes which correspond to the black and white keys of a piano keyboard.

6. A string instrument in accordance with claim 1, characterised in that the fingerboard of the instrument is provided with marks indicating the notes which correspond to the black and white keys of a piano keyboard.

7. A string instrument in accordance with claim 1, characterised in that it comprises more than six strings.

8. A string instrument in accordance with claim 7, characterised in that the fingerboard of the instrument is provided with marks indicating the notes which correspond to the black and white keys of a piano keyboard.

9. A string instrument in accordance with claim 7, characterised in that it comprises one or several bass strings, said bass strings being tuned to appr. one octave lower than the lowest one or ones of the rest of the strings.

10. A string instrument in accordance with claim 9, characterised in that the fingerboard of the instrument is provided with marks indicating the notes which correspond to the black and white keys of a piano keyboard.

* * * * *